US005449582A

United States Patent [19]

Hsieh et al.

[11] Patent Number: 5,449,582

[45] Date of Patent: Sep. 12, 1995

[54] PROCESSES FOR PIGMENT DISPERSION AND ARTICLES THEREFROM

[75] Inventors: Bing R. Hsieh, Webster; Andrew R. Melnyk, Rochester; Jerry H. Taylor, Webster; Paul A. Harmer, Ontario, all of N.Y.

[73] Assignee: Xerox Corporation, Stamford, Conn.

[21] Appl. No.: 254,721

[22] Filed: Jun. 6, 1994

[51] Int. Cl.[6] ..... G03G 5/06

[52] U.S. Cl. ..... 430/134; 430/135

[58] Field of Search ..... 430/135, 134

[56] References Cited

U.S. PATENT DOCUMENTS

| | | | |
|---|---|---|---|
| 5,131,776 | 7/1992 | Mott | 401/198 |
| 5,238,766 | 8/1993 | Molaire et al. | 430/135 |
| 5,334,478 | 8/1994 | Desilets et al. | 430/135 |

OTHER PUBLICATIONS

European Publication No. 0 555 950 A1; Mark Holbrook; Dispersion; Filed Apr. 1, 1993.

*Primary Examiner*—John Goodrow

*Attorney, Agent, or Firm*—John L. Haack

[57] ABSTRACT

A process for preparing ultrafine pigment dispersions comprising providing a solubilized mixture of pigment-Lewis acid complex and an aprotic organic solvent; precipitating the resulting solubilized complex into a protic solvent thereby forming a dispersion of ultrafine pigment particles; removing the aprotic and protic solvents to afford a wet cake containing finely divided pigment particles; optionally neutralizing and washing the wet cake particles; and redispersing the resulting ultrafine pigment particles in an aqueous solution, an organic solvent, or mixtures thereof, and a binder resin to form an ultrafine pigment and binder resin dispersion.

40 Claims, 6 Drawing Sheets

PROCESSES FOR PIGMENT DISPERSION AND ARTICLES THEREFROM

CROSS REFERENCE TO COPENDING APPLICATIONS AND RELATED PATENTS

Attention is directed to commonly assigned copending application Ser. No. 08/131,250, filed Oct. 4, 1993; and U.S. Ser. No. 08/011,590 filed Feb. 1, 1993.

Attention is also directed to commonly assigned U.S. Pat. No. 5,248,580, filed Oct. 4, 1993.

BACKGROUND OF THE INVENTION

This invention is generally directed to pigment dispersions, and more particularly to the preparation of dispersions containing ultrafine pigment particles, the preparation of thin films containing the ultrafine pigment particles, and to imaging members thereof. More specifically, the present invention is directed to Lewis acid-pigment solubilization processes for fabricating solution coated photosensitive pigment layers, and photo- and opto-electronic devices and imaging members thereof. In embodiments of the present invention, there are provided layered photoconductive imaging members with excellent xerographic properties, inclusive of high charge acceptance, low dark decay, high photosensitivity in the wavelength regions of from about 400 to about 900 nanometers, and maximum or peak photosensitivity in the wavelength regions of from about 600 to about 800 nanometers, enabling their selection for electrophotographic, especially xerographic, imaging systems and printers sensitive to near infrared wavelengths. In embodiments of the invention of the present application, there are provided imaging members with photoconductive layers comprised of ultrafine dispersed pigment particles illustrated herein, and charge or hole transport layers, especially those comprised of aryl amines, which members are sensitive to light in the wavelength region of from about 700 to about 820 nanometers. The resulting members are responsive to visible light and/or red illumination originating from light emitting diode (LED) printing apparatuses. Imaging members prepared by processes of the present invention can be used in, or in conjunction with, opto-electronic devices such as light emitting diodes, solar cells, organic electroluminescent emitters, field effect transistors, vacuum fluorescent displays, thin film transistors, and liquid crystal displays. The photoresponsive imaging members of the present invention can contain, for example, situated between a photogenerating layer and a charge transporting layer, or situated between a photogenerating layer and a supporting substrate with a charge transport layer in contact with the photogenerating layer, a photoconductive composition comprised of the ultrafine dispersed photogenerating pigments as illustrated herein.

In embodiments of the present invention, there are provided alternative and simplified processes, that are dissimilar from traditional high energy pigment attrition and high vacuum pigment sublimation processes, for the fabrication of pigment containing photosensitive layered devices. Known pigment attrition processes involves reduction of pigment particle size by high energy grinding or attrition typically conducted in a dispersion medium. The resulting pigment dispersion is then used to cast pigmented layers on selected substrates by, for example, known spray, dip, spin, and the like, coating techniques. Although fine pigment particles can be obtained by prolonged attrition processing, the resulting pigment dispersions often reagglomerate in time. A wide variety of pigment dispersants have been employed to avoid rapid aggregate formation with varying degrees of success. A binder resin, which may be solubilized along with the ultrafine pigment dispersion and/or precoated onto the substrates, is optionally used to provide necessary mechanical strength for the deposited pigment layer or layers. Pigment sublimation processes are known and involve heating pigment particles under high vacuum to vaporize the pigment molecules which are then condensed onto cooled substrates to form a pigment layer. Pure pigment layers with high degree of uniformity are achievable by the sublimation process. However, sublimation processing may be a complicated and expensive manufacturing proposition particularly for large scale production operations. Processes are also known for the preparation and purification of photosensitive pigments involving sequential dissolution and reprecipitation of the pigment using, for example, an organic or inorganic acid solvent system followed by a non solvent precipitating system as disclosed, for example, in U.S. Pat. Nos. 5,153,094 and 5,153,313. However, the pigment solutions disclosed in these patents have not been used directly in the preparation of photogenerating layers. Major disadvantages of using strong acid solvent solutions for larger scale production of films of photoconductive pigments include the highly corrosive and toxic nature of the acidic solvents; and acid solvents are generally not sufficiently volatile and are difficult to remove from the films.

In embodiments of the present invention, there are provided imaging members with a photoconductive layer comprised of mixtures of the ultrafine dispersed pigment particles as illustrated herein, wherein the resulting imaging member with a single photoconductive layer functions simultaneously both as charge generating layer and transport layer.

Certain layered imaging members are known, including those comprised of separate generating layers, and transport layers as described in U.S. Pat. No. 4,265,990; and overcoated photoresponsive materials containing a hole injecting layer overcoated with a hole transport layer, followed by an overcoating of a photogenerating layer; and a top coating of an insulating organic resin, reference U.S. Pat. No. 4,251,612. Examples of photogenerating layers disclosed in these patents include trigonal selenium and phthalocyanines, while examples of transport layers include certain diamines as mentioned therein.

The following United States patents are mentioned: U.S. Pat. No. 4,299,896 which discloses imaging members with a photosensitive layer selected from the diazo pigments of the formulas illustrated, for example, in the Abstract, and in column 2; U.S. Pat. No. 4,314,015 wherein the disazo pigments for the imaging member are of the formula as illustrated in the Abstract, for example, and column 2; U.S. Pat. No. 4,666,810 wherein the azo pigments are illustrated in column 2 for example; and U.S. Pat. No. 4,797,337 wherein the disazo photogenerating pigment is of the formula as illustrated in the Abstract, for example, which disazos may contain a $SO_2$ group.

Additional references illustrating layered organic electrophotographic photoconductor elements with azo, disazo, and related compounds include U.S. Pat. Nos. 4,390,611; 4,551,404; 4,596,754; 4,400,455;

4,390,608; 4,327,168; 4,299,896; 4,314,015; 4,486,522; 4,486,519; 4,555,667; 4,440,845; 4,486,800; 4,309,611; 4,418,133; 4,293,628; 4,427,753; 4,495,264; 4,359,513; 3,898,084; 4,830,944; 4,820,602; 4,755,443; 4,424,266; and Japanese Patent Publication 60-111247 and Japanese Patent 60-64354.

U.S. Pat. No. 4,882,254, discloses a layered photoresponsive imaging member which comprises a supporting substrate, a photogenerator layer comprising a mixture of first and second pigments, and an aryl amine hole transport layer. The mixture of pigments is selected from perylenes and phthalocyanines, polycyclic quinones and phthalocyanines, or perinones and phthalocyanines.

Photoresponsive imaging members containing perinone and perylene compounds are also known. For example, European Patent Publication 0040402, DE3019326, filed May 21, 1980, discloses the use of N,N'-disubstituted perylene-3,4,9,10-tetracarboxyldiimide pigments as photoconductive substances.

Imaging members with phthalocyanine materials are also known as disclosed in, for example, U.S. Pat. Nos. 3,594,163; 3,657,272; 3,816,118; 3,862,127; 3,903,107; 3,927,026; 3,932,180; 3,932,454; 4,031,109; 4,098,795; and U.S. Pat. Re. No. 27,117.

U.S. Pat. No. 5,134,048, issued Jul. 28, 1992, to Terrell et al., discloses an electrophotographic recording material comprising a conductive support and a photosensitive layer containing at least one photoconductive compound that has p-type charge generating capacity and is a substituted tetrabenzoporphyrin type compound. Pigment dispersions are prepared by acid pasting and salt grinding ball mill attrition methods.

European Patent Publication 0555950 A1, (Application No. 93300016.8) filed Jan. 4, 1993 discloses a dispersion of a finely divided pigment in a composition of water, one or more water-compatible resins and, as dispersant, a polycyclic aromatic compound having a water-solubilizing poly($C_{2-4}$-alkyleneoxy) chain containing from 3 to 50 alkyleneoxy groups, characterized in that the dispersion contains for 3% to 30% by weight of resin with respect to the total weight of water and resin in the dispersion. The dispersion is suitable for the preparation of water-borne paint and inks.

Processes for preparing imaging members by dispersion or suspension methodology are disclosed in U.S. Pat. Nos. 4,514,482, 4,555,463 and 4,587,189.

Imaging members and processes thereof are illustrated in the aforementioned copending applications U.S. Ser. No. 08/011,590 (D/92578) filed Feb. 1, 1993, for example, discloses a humidity detector comprised of a ladder polymer; and U.S. Ser. No. 08/131,250 (D/92566) filed Nov. 4, 1993, for example, discloses a process for forming thin films of pigment compounds, comprising providing a solubilized pigment-Lewis acid complex contained in an aprotic organic solvent system and coating the solubilized pigment-Lewis acid complex containing solvent system on a substrate; and U.S. Pat. No. 5,248,580, issued Sep. 28, 1993, for example, discloses a photoconductive imaging member comprised of a supporting substrate, a photogenerating layer comprised of a ladder polymer selected from the group consisting of those represented by the following formulas:

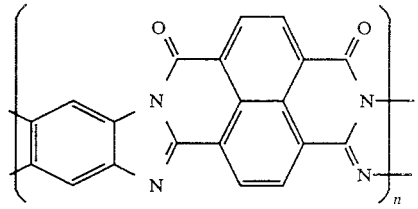

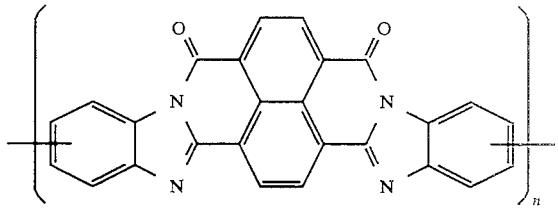

and mixtures thereof, wherein n represents the number of segments, and a charge transport layer.

The disclosures of each of the above mentioned patents and publications are totally incorporated by reference herein.

SUMMARY OF THE INVENTION

It is an object of the present invention to provide single layer and multilayered imaging members with many of the advantages illustrated herein.

Another object of the present invention is to provide certain photoconductive and photogenerating pigments in an ultrafine dispersed state, and imaging members thereof, which members can be sensitive to wavelengths of from about 400 to about 900 and preferably from about 600 to about 800 nanometers.

In another object of the present invention there are provided photoconductive and photogenerating ultrafine dispersed pigments and imaging members thereof, which members are substantially insensitive to visible light from about 400 to about 700 nanometers.

Another object of the present invention resides in the provision of layered photoresponsive imaging members which can possess excellent dark decay properties, high charge acceptance values, and high electrical stability.

Still another object of the present invention resides in providing a process for forming thin films and coatings of ultra finely dispersed pigment compounds, comprising: providing a solubilized pigment-Lewis acid complex contained in an aprotic organic solvent; providing a protic solution optionally containing surfactants and/or pigment dispersants; precipitating the solubilized complex into the protic solution to form a dispersion of ultrafine pigment particles: removing the solvent mixture to afford a wet cake containing finely divided or ultra finely dispersed pigment particles with an average primary particle size less than about 50 Angstroms; optionally neutralizing and washing the wet cake of ultrafine pigment particles; redispersing the ultrafine pigment particles in an aqueous or organic solvent, or mixtures thereof, a binder resin, and optionally a surfactant and/or pigment dispersant, to form an ultrafine pigment and binder resin dispersion; coating the redispersed pigment and binder mixture onto a substrate to form a photogenerating film or coating layer on the substrate: drying the coated substrate; and optionally applying a charge transporting layer and or a protective overcoating layer to the coated substrate.

Further, in another object of the present invention there are provided photoconductive imaging members that can be responsive to radiation from LED and related devices.

Additionally, another object of the present invention resides in the provision of imaging and printing methods with the photoconductive imaging members illustrated herein.

It is an object of the present invention to provide processes for solubilizing pigment particles into aprotic low boiling organic solvents containing Lewis acids.

In another object of the present invention to provide a process whereby redispersed ultrafine pigment particles in combination with a soluble or dispersible binder resin are used to solvent coat ultrafine pigment layers or thin films onto selected substrates or objects.

Another object of the present invention is to provide a dispersion of ultrafine pigment particles in a protic solvent or dispersion of ultrafine pigment particles in an aqueous or organic solvent from which a wet cake having non-agglomerating nanoparticulate pigment particles and extended shelf life or keep is prepared by removing the solvent.

Another object of the present invention is to provide ultrafine pigment particle dispersions which contain a mixture of two or more pigments for coating a mixed pigment layer or layers onto a selected substrate.

In yet another object of the present invention in embodiments there are provided layered imaging members with a substantially uniform, nanoparticulate photoconductive or photogenerating layer, thereby minimizing, or avoiding final print defects in, for example, high resolution imaging and high speed xerography.

In still yet another object of the present invention, in embodiments, there are provided thin film or layered imaging members with ultrafine photoactive pigment particle dispersions contained in binder resins and which films are substantially free of residual Lewis acid complexing agents.

In embodiments, the present invention provides a process for forming ultrafine dispersions of pigment compounds and thin films thereof, and which compounds are normally insoluble in aprotic organic solvents. The films are prepared in process embodiments from a solubilized pigment-Lewis acid complex contained in an aprotic organic solvent or aprotic solvent mixture, which processes comprise precipitating the solubilized complex into a protic solvent thereby forming a dispersion of ultrafine pigment particles; removing the solvent mixture to afford a wet cake of finely divided pigment particles; optionally neutralizing and washing the ultrafine pigment particles to remove residual Lewis acid; redispersing the ultrafine pigment particles in an aqueous or organic solvent, or mixtures thereof, a binder resin, and optionally surfactants and/or pigment dispersants to form an ultrafine pigment and binder resin dispersion; and coating the redispersed ultrafine pigment particle and binder dispersion mixture onto a substrate followed by drying.

The present invention also provides processes for preparing a photoconductive imaging member comprising: applying a charge transporting layer and or a protective overcoating layer to the aforementioned coated substrate.

In a preferred embodiment, photoconductive imaging members of the present invention are comprised of a supporting substrate, and a photogenerating layer in contact therewith comprised of a ultrafine or highly dispersed or nanoparticulate, pigment or pigment mixture prepared as illustrated and selected from the group consisting of metal phthalocyanines, oligomeric phthalocyanines, metal-free phthalocyanines, quinacridones, Monastral Violet and Monastral Red Y, substituted 2,4-diamino-triazines, squaraines, polynuclear aromatic quinones, thiopyrylium compounds, and the like.

The pigment solubilization and dispersion processes of the present invention use a pigment or mixture of pigments, a Lewis acid and a nonprotic or aprotic solvent and are generally applicable to pigments such as quinacridones, phthalocyanines, azo and polyazo, squarylium, cyanine pigments, and the like, that are rich in pi-electrons or electron donating heteroatoms, for example, nitrogen, sulfur, oxygen and other group VA and VIA chemical elements in the periodic table, and that are capable of coordinating with certain electron acceptors such as Lewis acids, for example, as selected from the group of metal halides such as $AlCl_3$, $GaCl_3$, $FeCl_3$, $InCl_3$, $SnCl_4$, $BF_3$, $ZnCl_2$, $TiCl_4$, $SbCl_3$, $SbCl_5$, $CuCl_2$, $SbF_5$, $VCl_4$, $TaCl_5$, $ZrCl_4$, $AsF_3$, and the like, and mixtures thereof. Although not desired to be limited by theory, the Lewis acid molecules are believed to readily coordinate with electron rich or electron donating heteroatoms or pi-electrons of the pigment molecules to form metal-pigment complexes that are soluble in selected polar aprotic solvents. The pigment solubilization step of the processes of the present invention is analogous in embodiments to solubilization of heterocyclic ladder and rigid rod polymers by Lewis acids as described, for example, by Jenekhe in U.S. Pat. Nos. 4,945,156 and 4,963,616 and by Jenekhe and Johnson in *Macromolecules,* 23, 4419 (1990) and references therein, particularly references 16 to 24, the disclosures of which are totally incorporated herein by reference. In addition, the ultrafine dispersed pigment thin films of the present invention may be prepared and characterized by the methodology described in the aforementioned Jenekhe references.

The solubilization processing of pigments of the present invention can be comprised of a one step or two step process that provides a complexed pigment solution comprised of pigment, a Lewis acid, and a polar aprotic solvent. In the one step operation, pigment complex formation and solubilization take place simultaneously or concurrently. In the two step operation, the first step involves forming a solid pigment-metaloid complex resulting from any suitable complexation reaction. A second step involves solubilization of the solid complex in a suitable organic solvent. A related two step process is described in U.S. Pat. No. 4,963,616, column 10, line 4. The resulting solutions obtained from either the one step or two step solubilization operation contain soluble pigment complexes that can then used to solvent coat pigmented layer or layers onto selected substrates, by known means, for example, of spray, spin, dip, and the like, coating techniques. The solubilized pigment complex can be precipitated directly and rapidly into a protic solvent such as water, or a non aqueous solvent with the agency of external cooling to control exothermicity which is not the situation in conventional acid pasting processing.

The redispersed ultrafine pigment particles of the present invention require no additional filtering to form photoreceptor imaging members with high sensitivity. Prior art processes generally require extensive filtering of the pigment dispersion, for example, for use in dip and related coating processes.

Photoconductive imaging members in accordance with the present invention contain a pigment or pigment mixture as a photogenerating substance present in an amount of 0.5 to 100 percent by weight of the charge or photogenerating layer. The pigment mixture contains at least a first pigment of from about 10 to about 50 weight percent of the pigment mixture and a second pigment of from about 40 to about 90 weight percent of the pigment mixture.

Typical organic photoconductive pigments include titanyl and vanadyl phthalocyanine, and other phthalocyanine compounds, metal-free phthalocyanine described in U.S. Pat. No. 3,357,989, metal phthalocyanines such as copper phthalocyanine and hydroxygalium phthalocyanine, quinacridones available from DuPont under the tradename Monastral Red, Monastral Violet and Monastral Red Y, substituted 2,4-diamino-triazines disclosed in U.S. Pat. No. 3,442,781, squaraine pigments, polynuclear aromatic quinones available from Allied Chemical Corporation under the tradename Indofast Double Scarlet, Indofast Violet Lake B, Indofast Brilliant Scarlet and Indofast Orange, thiopyrylium pigments, HOSTAPERM PINK E®, and the like, and mixtures thereof.

Lewis acids generally are electron acceptors which can combine with a donor molecule or ion by forming a coordinated chemical bond with two electrons from the donor molecule or ion. Typical Lewis acids include metal halides such as aluminum trichloride, $AlCl_3$, ferric trichloride, $FeCl_3$, stannic tetrachloride, $SnCl_4$, boron trifluoride, $BF_3$, $ZnCl_2$, $TiCl_4$, $SbCl_5$, $CuCl_2$, $SbF_5$, $VCl_4$, $TaCl_5$, $ZrCl_4$, and the like, and mixtures thereof. Other suitable complexing agents include nitrosyl ($NO^+$) salts, of the formula $NO^+A^-$where $A=BF_4$, $HSO_4$, $PF_6$, $SbCl_6$, $AsF_6$, and the like. The Lewis acids or other complexing agents selected should preferably be soluble in polar aprotic solvents and dissolve, react with, or controllably decompose in protic solvents.

A polar aprotic solvent or mixtures of polar aprotic solvents can be used for the preparation of the pigment complex solution of the present invention. The use of a mixture of about two to about 10 solvents can modify the solubilization, primary particle size, and coating behaviors of the resultant ultrafine pigment particles. The aggregation behavior of the solubilized pigment molecules, the viscosity of the resulting solution mixtures, and the morphological and electrical properties of the resulting pigmented layer or layers may also be influenced by the choice of solvent or solvents used in the solubilization process. A suitable polar aprotic solvent, in embodiments, may be selected from the group nitromethane, nitroethane, 1-nitropropane, 1,2-dichloroethane methylene chloride, benzene, toluene, and the like, and mixtures thereof. Additional useful solvents are disclosed, for example, in the aforementioned U.S. Pat. No. 4,963,616, column 8, line 54. Any amount of solvent is suitable so long as the solubization and other objects of the present invention are achieved.

A number of binder resins, such as from one to about 10 binder resins may be present in the redispersed ultrafine pigment particle and binder resin mixture. Another binder resin, which may be the same or different to those used in the redispersed pigment mixture, can be precoated as a thin film on the selected substrate prior to the deposition of the ultrafine pigment and binder dispersion. A binder resin is used to impart desired mechanical properties to the deposited ultrafine pigment particle layer or layers and to provide an adhesive property for subsequently deposited layers. One or more binder resins may also be used to modify the viscosity of the redispersed ultrafine pigment particles and binder resin mixture to improve the coating processes, to modify the morphology and electrical properties, and to minimize the thickness of the deposited pigment layers. A binder resin or mixture of resins may be used in amounts of from about 0.1 to about 99.8 percent by weight of the total weight of the dispersion of ultrafine pigment particles used in forming the charge generating layer.

Any suitable resin binder or pigment dispersant material may be employed in the charge generator layer. Typical organic resinous binders or dispersants include polycarbonates, acrylate polymers, vinyl polymers, polyvinylcarbazole, polyesters, polysiloxanes, polyamides, polyurethanes, epoxies, and the like, and mixtures thereof, as disclosed in U.S. Pat. No. 3,121,006 and U.S. Pat. No. 4,439,507. Organic resinous binder polymers or pigment dispersants may be block, random or alternating copolymers and terpolymers.

The photogenerating layer containing photoconductive pigments, and the resinous binder material generally range in thickness of from about 0.1 micrometer to about 5.0 micrometers, and preferably have a thickness of from about 0.3 micrometer to about 3.0 micrometers. Other thicknesses may be selected such that the objects of the present invention are achieved.

Lewis acid complexed pigment solutions may optionally contain a mixture of two to about 10 solubilized pigments for the purpose of preparing a predispersion of ultrafine particulate sized mixed pigments for subsequent coating to form a substantially microscopically homogeneous mixed nanoparticulate pigment layer or layers on a selected substrate. For example, a mixed pigment complex solution of benzimidazole perylene (BZP) and titanyl phthalocyanine (TiOPc) can be prepared for solvent coating in embodiments of the present invention to form a mixed molecular dispersion of pigments in a single layer. In addition, a plurality of ultrafine pigment particulate dispersions containing different mixtures of nanoparticulate pigments may be coated or deposited layerwise as disclosed herein to provide devices useful, for example, in imaging processes with unique multilayer architectures. For example, an ultrafine benzimidazole perylene particulate dispersion and a titanyl phthalocyanine particulate dispersion can be independently prepared and then used to sequentially coat and form a device with, for example, alternating layers of the aforementioned dissimilar pigments.

The aforementioned nanoparticulate pigment dispersions may be optionally doped in amounts of from about 0.01 to about 50 weight percent of the total weight of the pigment with either p or n type components known in the semiconductor art, including for example $I_2$, $AsF_5$, $FeCl_3$, KI, and the like, to impart desired conductivities thereof. Alternatively, omitting a washing step or selectively washing the ultrafine pigment wet cake may be employed to intentionally impart desired conductivity levels arising from residual Lewis acid compounds or their solvolysis products.

Also, the present invention in embodiments can be accomplished by the provision of single layer or multilayered imaging members thereof. More specifically, the present invention is directed to photoconductive imaging members with a photoconductive pigment such as benzimidazole perylene and its analogues, perylene tetracarboxyl diimide derivatives, quinacridone derivatives, polyazo pigments, and phthalocyanine compounds, including oligomeric phthalocyanines, and mixtures thereof. Examples of photogenerating pigments that may be solubilized, substantially completely or partially, in organic solvents in the presence of Lewis acids to fabricate imaging members of the present invention include those of formulae illustrated in FIGS. 7 to 9. Other suitable photoconductive pigments are described by K. Y. Law, for example, in "Organic Photoconductors: Recent Trends and Developments," *Chemical Reviews,* Vol. 93, No. 1 (1993), Jan/Feb.

A general description of the fabrication of highly dispersed pigment layers of the present invention in embodiments comprises: providing a pigment-Lewis acid complex solution by mixing a pigment and a Lewis acid in a low boiling aprotic organic solvent such as nitromethane, chloroform, methylene chloride and the like; precipitating the solubilized complex into a protic solvent thereby forming a dispersion of ultrafine pigment particles with a primary particle size of less than about 100 Angstroms as measured by electron microscopy, X-ray diffraction, and other known particle size measurement techniques; removing the solvent mixture to afford a wet cake of finely divided pigment particles; optionally neutralizing and washing the ultrafine pigment particles to provide finely divided pigment particles with a primary particle size of about 20 to about 80 Angstroms which are substantially free of Lewis acid residues; redispersing the ultrafine pigment particles into an aqueous or organic solvent, or mixtures thereof, a binder resin, and optionally a surfactant or pigment dispersant to form an ultrafine pigment particle and binder resin solvent dispersion; and coating and then drying the pigment resin solvent dispersion to form highly dispersed photoactive pigment resin layers.

In other embodiments, processes for preparing imaging members having dispersed pigments comprise: providing a pigment-Lewis acid complex solution by mixing a pigment and a Lewis acid in a low boiling aprotic organic solvent; precipitating ultrafine pigment particles from solution by the controlled addition of a nonsolvent or diluent for the aprotic organic solvent used to dissolve the Lewis acid pigment complex; removing the solvent from the mixture, by for example, evaporation, filtration or centrifugation; and washing the resultant pigment wet cake with a polar protic solvent such as water, methanol, ethanol, propanol, isopropanol, acetic acid and mixtures thereof, in admixture with, for example, formamide, acetone, acetonitrile, dimethylformamide, N-methyl-2-pyrrolidone, and mixtures thereof to decompose, dissolve and subsequently selectively remove substantial amounts of the Lewis acid component from the pigment particles. A suitable pigment weight percent in a pigment-complex solution is from about 0.005 to about 20 percent, and preferably from about 1 to about 10 percent. The molar ratio of Lewis acid or Lewis acid mixture to pigment molecules is preferably equal to, or greater than, the number of electron donating elements present in the pigment molecule. In embodiments, the molar ratio of Lewis acid to pigment used in forming Lewis acid-pigment complex solutions is of from about 1:1 to about 20:1.

The highly dispersed pigment containing binder layers prepared by processes of the present invention involving extensive pigment wet cake washing were found to contain only trace amounts of Lewis acid species which were measurable by energy dispersive X-ray analysis and related spectroscopic means. When the wet cake is not neutralized and washed prior to being redispersed in aqueous and organic solvents the level of residual Lewis acid species or ions are considerably higher. Residual Lewis acid derived ions remaining in thin films or layers may range from about 10 to about 10,000 parts per million depending on preparative procedures selected. When the wet cake is neutralized and washed prior to being redispersed in solvent the resulting films or coatings are substantially free of residual Lewis acid species.

In one embodiment, there is envisioned a layered photoresponsive member comprised of a supporting substrate, a photoconductive layer comprised of the highly dispersed nanometer sized pigments illustrated herein, and situated between the supporting substrate, and the photoconductive layer a charge transport layer. In one specific illustrative embodiment, the photoresponsive device can be comprised respectively of (1) a supporting substrate, (2) a hole blocking layer, (3) an optional adhesive interface layer, (4) a photogenerating layer comprised of dispersed pigment nanoparticles, or mixtures thereof, (5) a charge transport layer, and (6) optionally a protective overcoat layer. Thus, a specific photoresponsive device of the present invention can be comprised of a conductive supporting substrate, a hole blocking metal oxide layer in contact therewith, an adhesive layer, a photogenerating layer comprised of an ultrafine dispersion of a nanoparticulate pigment or mixed nanoparticulate pigments dispersed in a pigment binder, respectively, overcoated on the optional adhesive layer, and as a top layer a hole transport layer comprised of certain diamines dispersed in a resinous matrix. The photoconductive layer composition when in contact with the hole transport layer is capable of allowing holes generated by the photogenerating layer to be transported. Examples of aryl amine hole transport molecules that may be selected for the photoconductor devices are illustrated in U.S. Pat. No. 4,265,990, the disclosure of which is totally incorporated herein by reference. Also, examples of charge transport molecules are illustrated in U.S. Pat. No. 4,921,773 and the patents mentioned therein.

Another advantage of using nanodispersed pigments as charge generators includes the ability to form a charge generation layer that is highly uniform and homogeneous and if desired, is essentially nonagglomerated. A charge generator layer that is homogeneous and nonparticulate eliminates irreproducibilities associated with the particulate nature of the generation layer, for example, the stability of the coating dispersions, particle size, distribution of particle sizes, and the way conventional charge generator pigment particles organize themselves during coating and curing processes. Organization of particles may affect the charge migration process. Charge generation layers prepared from resin binder pigment dispersion of the present invention exhibit substantially none of the disadvantages associated with inhomogeneous and agglomerated particulate generator layers.

In other embodiments of the present invention, there is provided a method of imaging comprising the steps of generating an electrostatic image on the aforementioned photoconductive imaging members; subsequently developing the electrostatic image; transferring the developed electrostatic image to a suitable substrate; and permanently affixing the transferred image to the substrate. The electrostatic image can be developed by, for example, cascade, touchdown, powder cloud, or magnetic brush methods. The developed electrostatic image can be transferred to a substrate by, for example, means of a corotron or a biased roll.

The photoresponsive devices described herein can be incorporated into various imaging systems such as those conventionally known as xerographic imaging processes. Additionally, the imaging members of the present invention can be selected for imaging and printing processes and systems with near red and/or infrared light. In this embodiment, the photoresponsive devices may be negatively or positively charged, exposed to light in a wavelength of from about 400 to about 900, and preferably 600 to 800 nanometers, either sequentially or simultaneously, followed by developing the resulting image and transferring to paper. Additionally, the imaging members of the present invention can be selected for imaging and printing processes and systems with visible light. In this embodiment, the photoresponsive devices may be negatively or positively charged, exposed to light in a wavelength of from about 400 to about 700 nanometers. The molecularly dispersed pigments may optionally be chosen so as to be insensitive in this region and therefore would not participate in the charge generation process thereby enabling multiple exposure light selective imaging processes.

BRIEF DESCRIPTION OF THE FIGURES

For a further understanding of the the present invention, the following detailed description of various embodiments is provided wherein.

DESCRIPTION OF SPECIFIC EMBODIMENTS

Specific embodiments of the invention will now be illustrated, it being noted that substantially equivalent imaging members are also embraced within the scope of the present invention.

Figure 1:
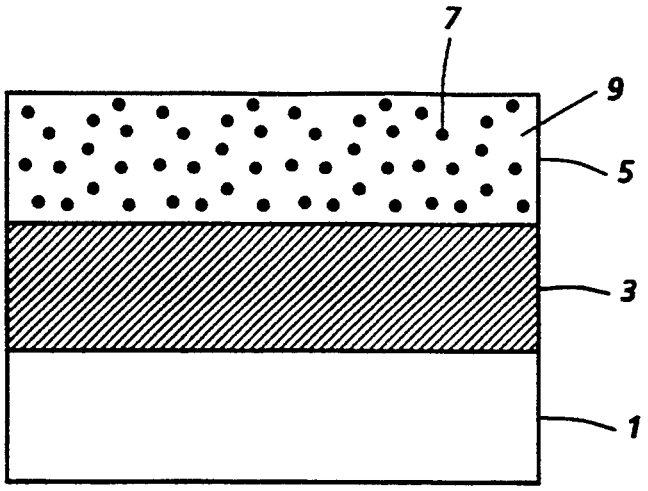
FIGS. 1, 2 and 3 are partially schematic views of examples of photoconductive imaging members of the present invention.
Figure 7:
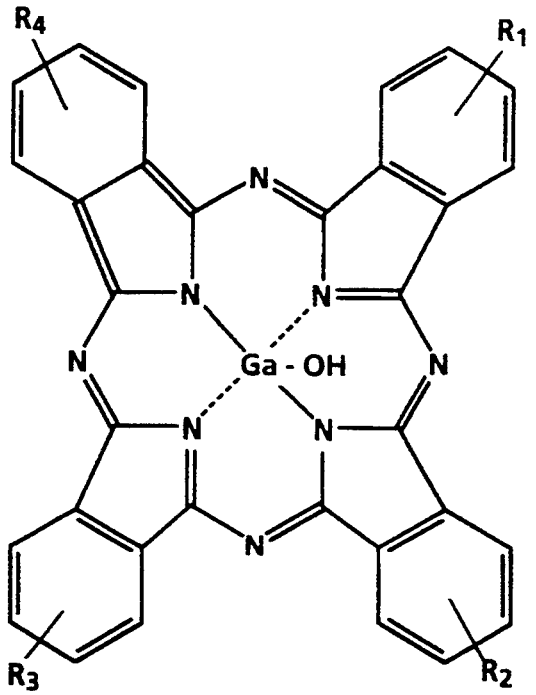
FIGS. 7 to 9 are chemical formulas representative of readily soluble and redispersible pigment compounds useful in the present invention and where certain pigment compounds possessing structural isomers may contain pure isomers or contain mixtures of both cis and trans (E and Z) isomeric segments as indicated in embodiments. The substituents represented by R may be any suitable radical provided the objects of the present invention are achieved.
Figure 8:
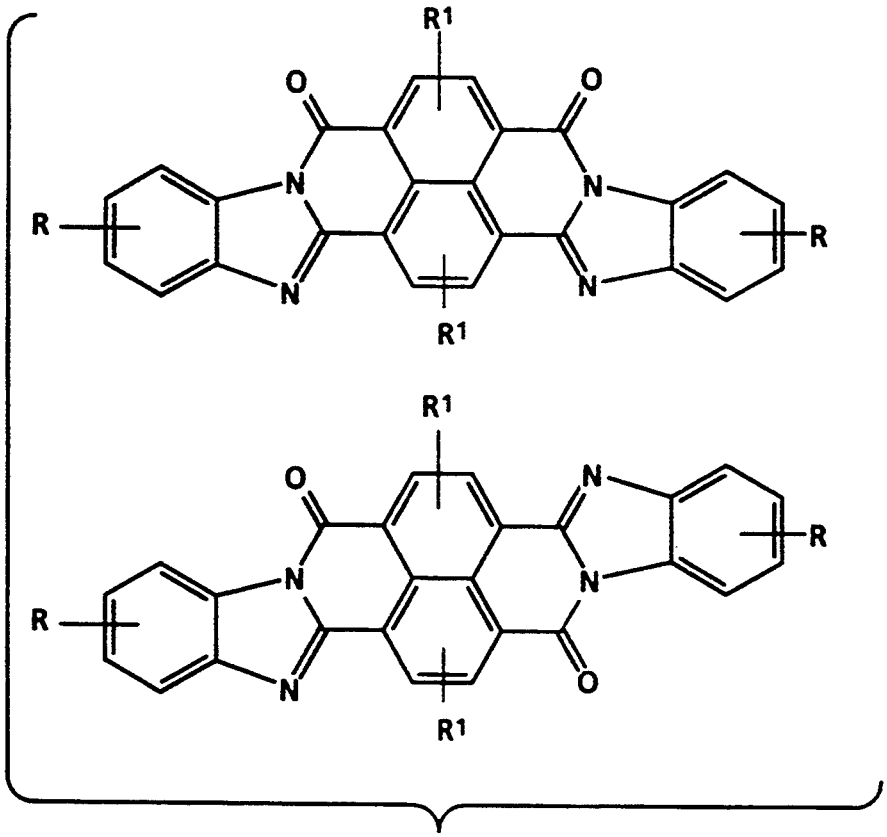
Figure 9:
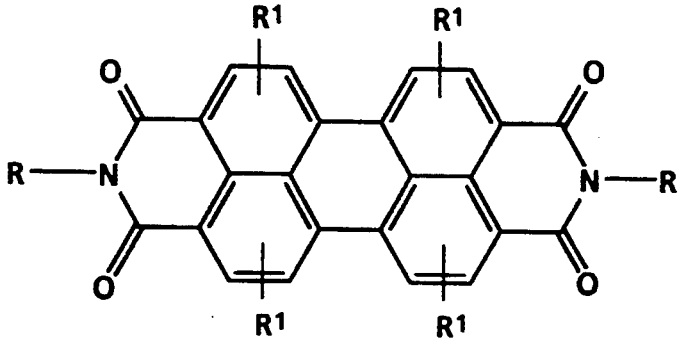

FIG. 1 illustrates a photoconductive imaging member of the present invention comprising a supporting substrate 1, a photogenerating layer 3 comprised of a highly dispersed pigment or nanodispersed pigment mixtures selected in embodiments from the formulas shown in FIGS. 7 through 9, and preferably the formulas of FIGS. 7 or 8 as illustrated herein, and an optional charge carrier hole transport layer 5, which comprises hole charge transporting molecules 7 dispersed in an inactive resinous binder composition 9. Layer 5 can be comprised solely of an optional hole transporting polymer, such as poly(methylphenylsilylene), poly(arylamine carbonates), poly(ether carbonates), and the like.

Figure 2:
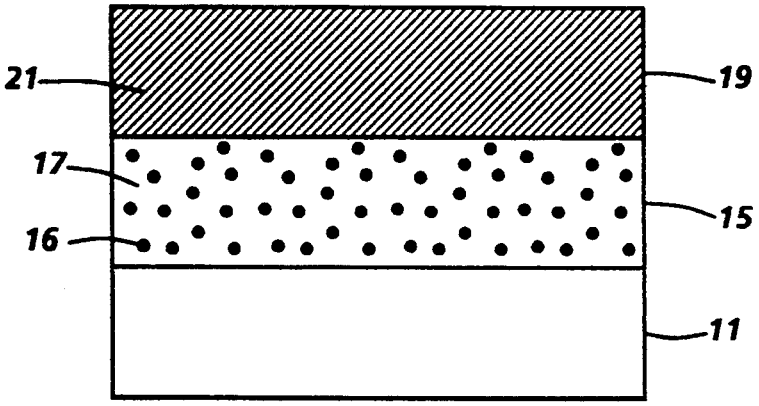

FIG. 2 illustrates essentially the same member as that shown in FIG. 1 with the exception that the hole transport layer is situated between the supporting substrate and the photogenerating layer. More specifically, this Figure illustrates a photoconductive imaging member comprising a supporting substrate 11, a hole transport layer 15 comprising aryl amine hole transport molecules 16 dispersed in an inactive resinous binder composition 17, and a photogenerating layer 19 comprising the highly dispersed pigments or pigment compound 21 of the formula, for example, of FIG. 7 as illustrated herein, especially those as represented by FIGS. 7 or 8, or mixtures thereof.

Figure 3:
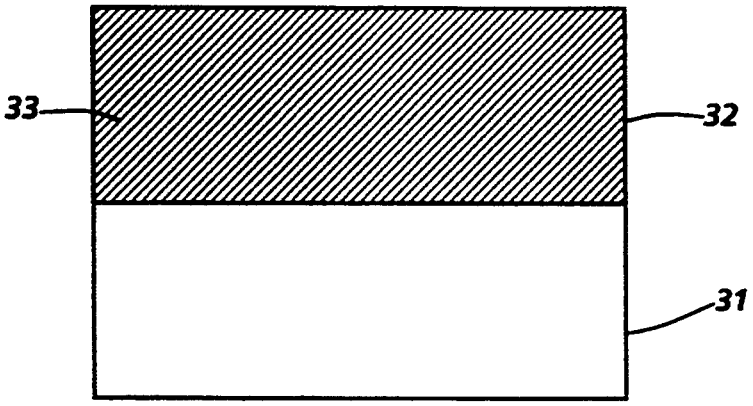

FIG. 3 illustrates a photoconductive imaging member of the present invention comprising a supporting substrate 31, a photoconductive layer 32 comprising the highly dispersed pigment 33, and an optional (not shown) charge transport layer 35 comprised of aryl diamine molecules 36 dispersed in a MAKROLON® polycarbonate binder 37.

Figure 4:
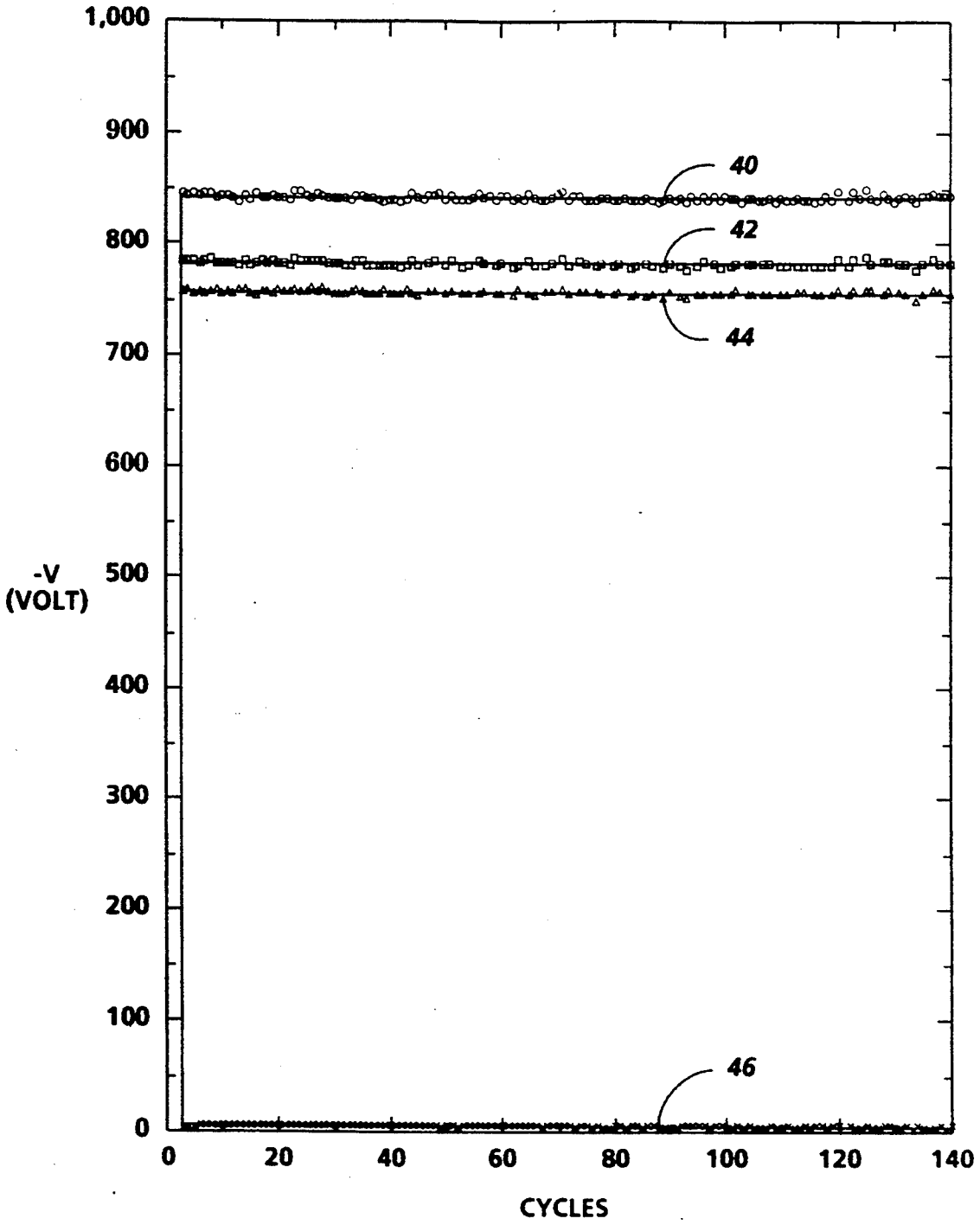
FIGS. 4, 5 and 6 represent respectively: device voltage stability with cycling; dark discharge voltage after charge-erase cycling; and a photodischarge curve of a molecularly disperse pigment containing imaging members of the present invention.

FIG. 4 illustrates voltage (−V) stability with cycling of a molecularly disperse pigment containing imaging device of the present invention. For example, a device voltage with cycling is shown for four voltages, three after charging 40 (0.19 sec), 42 (0.75 sec) and 44 (1.13 sec) and one after light erasure 46 ($V_R$). As is evident from this Figure, the voltages are very stable with continued cycling. Random variation of less than 10 volts is due to about a 1% variation in corotron charging and systematic variations when voltage is less than 1 volt. The device was cycled through over 1,000 cumulative cycles and the voltage changed by less than 10 volts under constant charge conditions. The residual voltage ($V_R$) remained at less than 5 volts over the cumulative 1,000 cycles.

Figure 5:
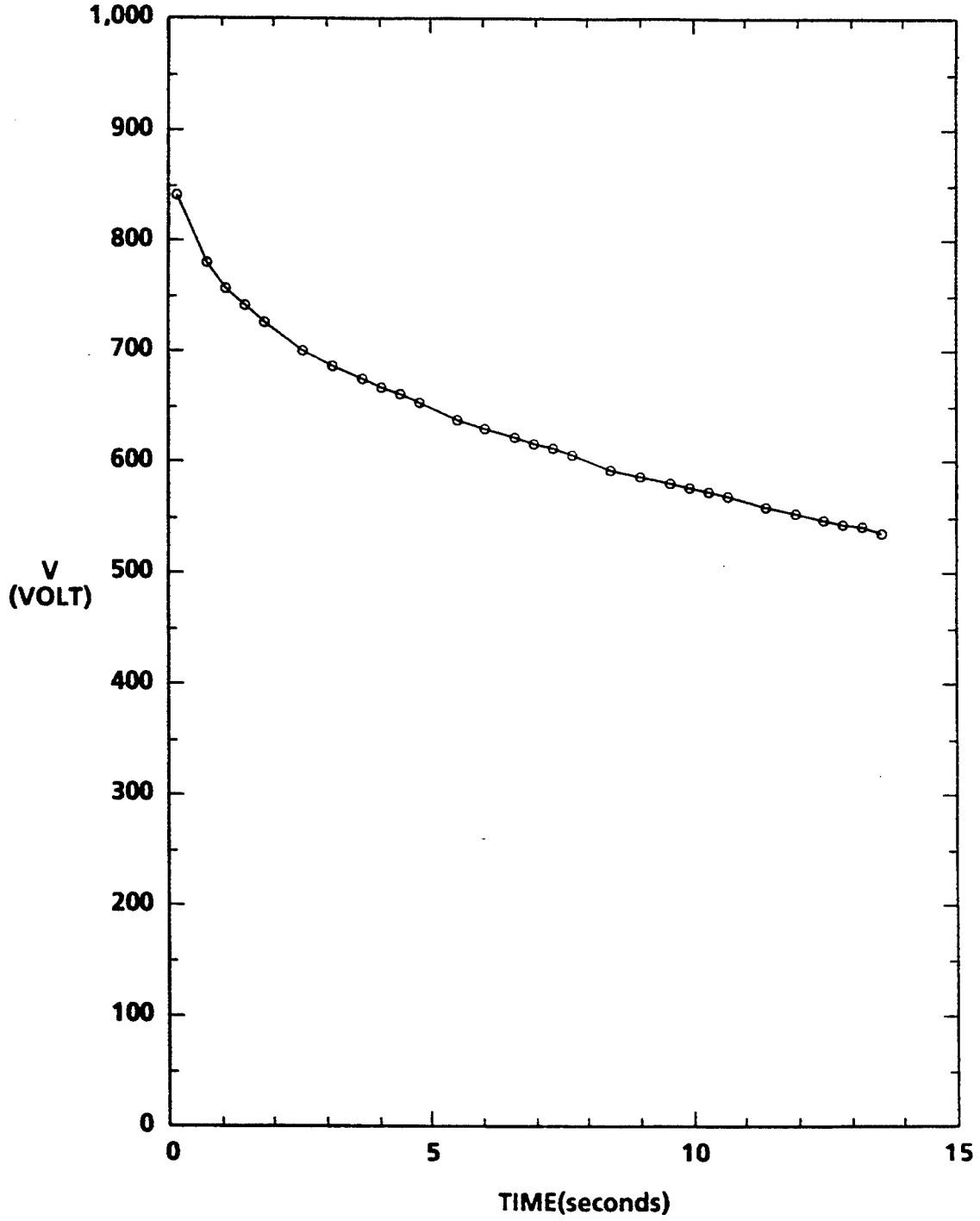

FIG. 5 illustrates typical dark discharge after charge-erase cycling, with an average dark discharge over 10 seconds of about 27 volts per second.

Figure 6:
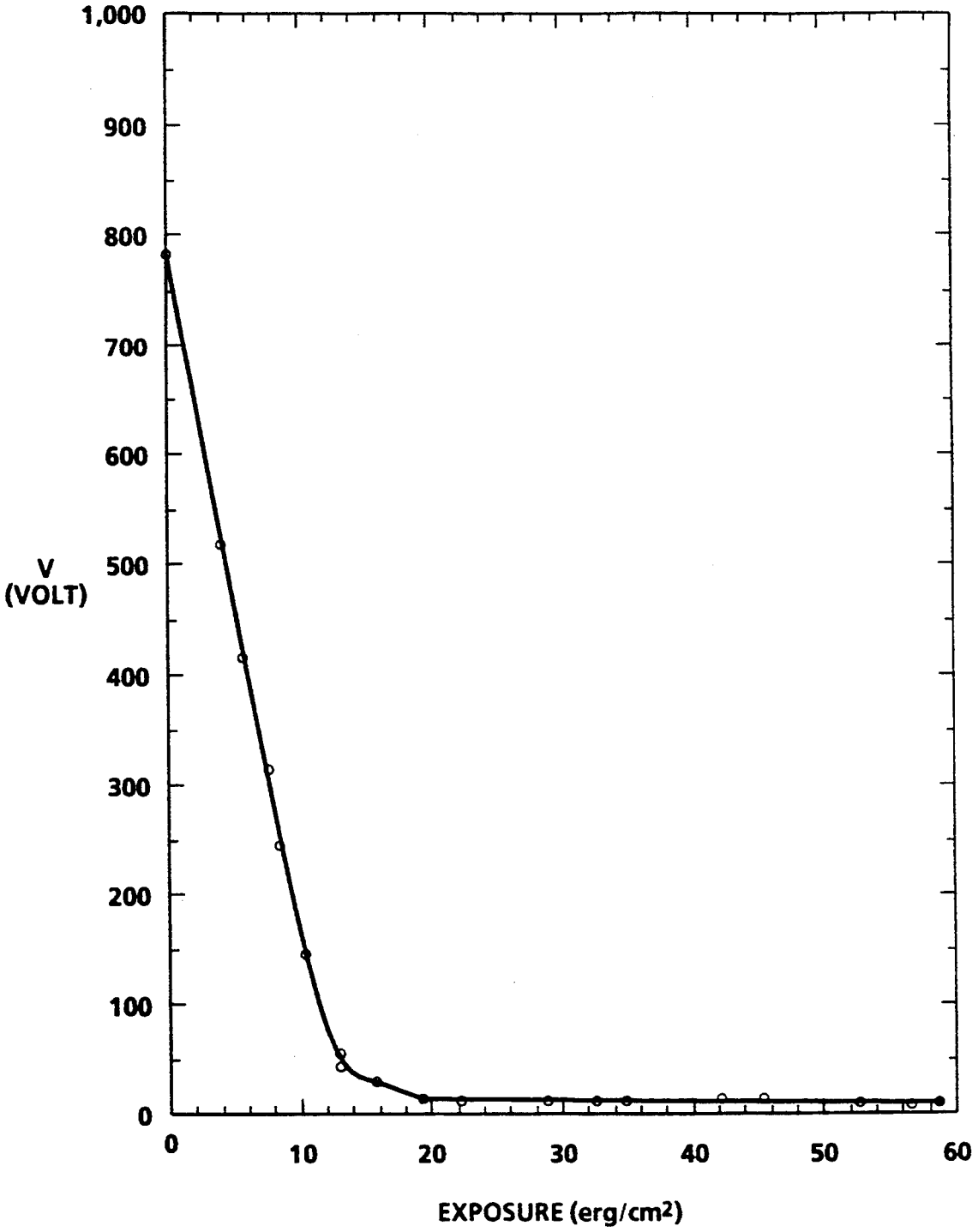

FIG. 6 illustrates a typical discharge curve of a photoconductive imaging member prepared by processes of the instant invention observed at 0.75 seconds after charging and 0.375 seconds after exposure to 670 nm light.

FIGS. 7, 8 and 9 are hydroxy gallium phthalocyanine, benzimidazole perylenes, and perylene derivatives, respectively, which exemplary photoactive pigment compounds are useful in imaging processes and imaging member embodiments of the present invention.

The supporting substrate of the imaging members may comprise an insulating material such as an inorganic or organic polymeric material, including MYLAR®, a commercially available polymer, and titanized MYLAR®; a layer of an organic or inorganic material having a semiconductive surface layer such as indium tin oxide or aluminum arranged thereon; or a conductive material such as aluminum, titanium, chromium, nickel, brass, or the like. The substrate may be flexible, seamless, or rigid and may have a number of different configurations, such as a plate, a cylindrical drum, a scroll, an endless flexible belt, and the like. In one embodiment, the substrate is in the form of an endless flexible belt. In some situations, it may be desirable to coat an anticurl layer, such as polycarbonate materials commercially available as MAKROLON® on the back of the substrate, particularly when the substrate is an organic polymeric material.

The thickness of the substrate layer depends on a number of factors, including economic considerations, the components of the other layers, and the like. Thus, this layer may be of substantial thickness, for example up to 125 mils, or of minimal thickness provided that there are no adverse effects on the resulting imaging device or imaging process. In embodiments, the thickness of this layer is from about 3 mils to about 20 mils.

Generally, the photogenerating or photoconductive layer has a thickness of from about 0.05 micron to about 25 microns or more and preferably from 1 to about 5 microns. The thickness of the ultrafine pigment dispersion and binder mixture contained in the charge generation layer is dependent primarily on the wavelength of the incident light. For example, if the xerographic imaging is done using visible light (400 to 700 nanometers range) where selected pigment compounds may be strongly absorbing, thin generation layers (about 0.2 to 2 microns or less) will suffice; if near infrared light, as produced by solid state lasers near 780 nanometers, is used for imaging, thicker generation layers (typically 5 to 30 microns) may be needed. Optionally, single layer photoconductors comprised solely of the photoactive ultrafine pigments dispersed in a coating solution or dispersed in a coating solution containing a soluble polymer binder can be used. Generally, it is desirable to provide this layer in a thickness sufficient to absorb a substantial amount, for example, from about 80 to about 90 percent or more, of the incident radiation which is directed upon it in the imagewise or printing exposure step. The maximum thickness of this layer is also dependent upon factors such as mechanical considerations, the thicknesses of the other layers, and whether a flexible photoconductive imaging member is desired.

The charge transport layer can be comprised of various components providing, for example, that they effectively transport charges (holes) such as an aryl amine compound dispersed in a resinous binder and other components, reference the aforementioned '773 patent, and U.S. Pat. No. 4,933,24. In embodiments, the charge transport layers are comprised of aryl amine compounds of the formula:

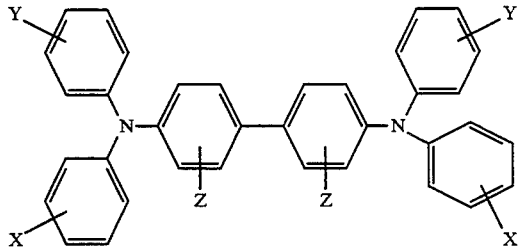

wherein X, Y and Z are selected from the group consisting of hydrogen, an alkyl group with, for example, from 1 to about 25 carbon atoms such as methyl, ethyl, propyl, isopropyl, and the like, and a halogen preferably chlorine, and at least one of X, Y and Z is independently an alkyl group or chlorine. When Y and Z are hydrogen, the amine is N,N'-diphenyl-N,N'-bis(alkylphenyl)-[1,1'-biphenyl]-4,4'-diamine wherein the alkyl is, for example, methyl, ethyl, propyl, n-butyl, or the like, or N,N'-diphenyl-N,N'-bis(chlorophenyl)-[1,1'-biphenyl]-4,4'-diamine. Preferably, X is selected from the group consisting of methyl, methoxychloride and hydroxy in either the ortho, meta, or para positions. Suitable inactive binder materials for the hole transport layer include known highly insulating resins, which generally have a resistivity of at least $10^{12}$ ohm-cm to prevent undue dark decay. Compounds corresponding to the above formula include N,N'-diphenyl-N,N'-bis(alkylphenyl)-[1,1'-biphenyl]-4,4'-diamine, wherein alkyl is selected from the group consisting of methyl, such as 2-methyl, 3-methyl and 4-methyl, ethyl, propyl, butyl, hexyl, and the like. With halo substitution, the amine is N,N'-diphenyl-N,N'-bis(halo phenyl)-[1,1'-biphenyl]-4,4'diamine, wherein halo is 2-chloro, 3-chloro or 4-chloro. Other electrically active small molecules that can be dispersed in the electrically inactive resin to form a layer which will transport holes include bis(4-diethylamino-2-methylphenyl)phenyl methane, 4',4''-bis(-diethylamino)-2',2''-dimethyltriphenyl methane, bis-4-(diethylaminophenyl)phenyl methane, and 4,4'-bis(diethylamino)-2,2'-dimethyltriphenyl methane. Generally, the hole transport layer has a thickness of from about 5 to about 75 microns, and preferably of from about 10 to about 40 microns.

Charge transport layers are well known in the art. Typical transport layers are described, for example, in U.S. Pat. Nos. 4,265,990; 4,609,605; 4,297,424 and 4,921,773. Organic charge transport materials can also be employed. Typical charge, especially hole transporting materials include the following exemplary compounds.

Hole transport molecules of the type described in U.S. Pat. Nos. 4,306,008; 4,304,829; 4,233,384; 4,115,116; 4,299,897 and 4,081,274, and 5,139,910, can be selected for the imaging members of the present invention. Typical diamine hole transport molecules include N,N'-diphenyl-N,N'-bis(3-methylphenyl)-(1,1'-biphenyl)-4,4'-diamine, and the like.

Pyrazoline transport molecules as disclosed in U.S. Pat. Nos. 4,315,982; 4,278,746 and 3,837,851, can also be selected in embodiments.

Substituted fluorine charge transport molecules as described in U.S. Pat. No. 4,245,02, can also be selected in embodiments.

Oxadiazole transport molecules, such as 2,5-bis(4-diethylaminophenyl)-1,3,4-oxadiazole, pyrazoline, imidazole, triazole, and the like may also be selected as charge transport molecules in embodiments. Other typical oxadiazole transport molecules are described, for example, in German Patents 1,058,836; 1,060,260 and 1,120,875, can also be selected in embodiments.

Other specific hole transports include hydrazone transport molecules, such as p-diethylamino benzaldehyde-(diphenylhydrazone), 4-methoxynaphthlene-1-carbaldehyde, 1-methyl-1-phenylhydrazone, and the like. Other typical hydrazone transport molecules are described, for example, in U.S. Pat. Nos. 4,150,987; 4,385,106; 4,338,388; 4,387,147; 4,256,821 and 4,297,426. Other specific transport molecules are described in U.S. Pat. Nos. 3,895,944; 3,820,989 and 3,870,516.

Other useful charge transport materials that may be selected, it is believed, include those described in the following U.S. Pat. Nos.: 4,806,443, 4,818,650, 4,806,444, 4,935,487, 4,956,440, 4,801,517, 5,028,687, and 5,030,532.

Still another class of charge transporting polymers are represented by the polysilylene formula:

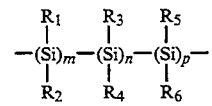

wherein $R_1$, $R_2$, $R_3$, $R_4$, $R_5$, and $R_6$ are independently selected from the group consisting of alkyl, aryl, substituted alkyl, substituted aryl, and alkoxy; and m, n, and p are numbers that reflect the percentage of the particular monomer unit in the total polymer composition with the sum of m plus n plus p being equal to 100 percent, for example, as described in U.S. Pat. No. 4,839,451.

Some illustrative examples of the polysilylene transport layers include poly(methylphenyl silylene), poly(-methylphenyl silylene-codimethyl silylene), poly(cyclohexylmethyl silylene), poly(tertiarybutylmethyl silylene) poly(phenylethyl silylene), and the like, which polysilylenes generally have a weight average molecular weight of from about 100,000 to about 2,000,000.

Examples of highly insulating and transparent resinous components or inactive binder resinous material for the transport layer include materials such as those described in U.S. Pat. No. 3,121,006. Specific examples of suitable organic resinous materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binder materials are polycarbonate resins having a molecular weight of from about 20,000 to about 100,000 with a molecular weight in the range of from about 50,000 to about 100,000 being particularly preferred. The materials most preferred as electrically inactive resinous materials in embodiments of the present invention are poly(4,4'-dipropylidinediphenyline carbonate) with a weight average molecular weight of from about 35,000 to about 40,000, available as LEXAN 145 TM; poly(4,4'-isopropylidine-diphenyline carbonate) with a weight average molecular weight of from about 40,000 to about 45,000, available as LEXAN 141 TM; a polycarbonate resin having a weight average molecular weight of from about 50,000 to about 100,000, available as MAKROLON®; and a polycarbonate having a weight average molecular weight of from about 20,000 to about 50,000, available as MERLON TM. Generally, the resinous binder contains from about 10 to about 75 percent by weight of the active material corresponding to the foregoing formula, and preferably from about 35 percent to about 50 percent of this material.

The photoconductive imaging member may optionally contain a hole blocking layer situated between the supporting substrate and the photogenerating layer. This layer may comprise metal oxides, such as aluminum oxide and the like, or materials such as silanes, nylons, and the like. The primary purpose of this layer is to prevent hole injection from the substrate during and after charging. Typically, this layer is of a thickness of about 5 to about 300 Angstroms, although it may be as thick as 2 microns in some instances.

In addition, the photoconductive imaging member may also optionally contain an adhesive interface layer situated between the hole blocking layer and the photogenerating layer. This layer may comprise a polymeric material such as polyester, polyvinyl butyral, polyvinyl pyrrolidone, and the like. Typically, this layer is, for example, of a thickness of less than about 0.6 micron with a thickness range of from about 0.05 to about 1 micron being suitable in embodiments of the present invention.

Photosensitivity values ($E_{0.5ddp}$ at 750 nanometers) for the imaging members of the present invention in embodiments thereof are acceptable and in some instances excellent, and can be, for example, from about 2 to about 25 ergs per square centimeter. Acceptable photosensitivity values vary depending on the design of the imaging apparatus in which the imaging members are contained and wavelength of the radiation used; thus, in some instances, values as high as 40 or 50 are acceptable, and values of less than about 5 may be preferred.

Although not wishing to be limited by theory, it is believed that the high sensitivities observed, in embodiments, particularly in the infrared region, with imaging members of the present invention derive from ultrafine pigment particle crystal packing which is similar to the packing obtained in vacuum deposition processes.

The present invention also encompasses a method of generating images with the photoconductive imaging members disclosed herein. The method comprises the steps of generating an electrostatic image on a photoconductive imaging member of the present invention, subsequently developing the electrostatic image with known developer compositions comprised of resin particles, pigment particles, additives, including charge control agents and carrier particles, reference U.S. Pat. Nos. 4,558,108; 4,560,535; 3,590,000; 4,264,672; 3,900,588 and 3,849,182, transferring the developed electrostatic image to a suitable substrate, and permanently affixing the transferred image to the substrate. Development of the image may be achieved by a number of methods, such as cascade, touchdown, powder cloud, magnetic brush, and the like. Transfer of the developed image to a substrate may be by any method, including those wherein a corotron or a biased roll is selected. The fixing step may be performed by means of any suitable method, such as flash fusing, heat fusing, pressure fusing, vapor fusing, and the like.

The processes of the present invention for preparing highly dispersed ultrafine pigment loaded generator layer thin films enables: solvent based coating of ultrafine pigment particles dispersed in a suitable binder resin and an aqueous or mixed solvent combination using conventional coating technology without filteration; a high level of control of pigment particle size, size distribution, and pigment morphology or polymorphology; minimization of pigment agglomeration; purification of the pigment or pigment mixture by way of a dissolution step upon complexation and subsequent precipitation or reconstitution steps; and chemical analysis of nanodispersed pigment particle and binder layers may be accomplished using, for example, known thin film spectroscopic techniques.

By the terms "nanodispersed" or "ultrafine pigment dispersion" is meant that, in embodiments, the pigment containing dispersion or suspension in combination with binder resin or the generator layer prepared by the processes of the present invention exhibit essentially a homogeneous or uniform distribution of individual pigment molecules with little or no agglomeration or aggregation of pigment molecules into larger particulate entities leading to a non-homogeneous distribution of pigment molecules.

A random sampling and X-ray diffraction analysis of nanodispersed pigment thin films prepared in the present invention indicated that no particulate or crystalline bodies greater than about 50 to 100 Angstroms were detectable. In embodiments, the average primary particle size of the ultrafine pigment particles was less than about 30 to about 50 Angstroms as measured by X-ray diffraction, these particle sizes are smaller than by about three to about five times the sizes obtained by pigment sublimation or pigment attrition methodologies.

Analysis of thin films prepared without an optional neutralization and washing step of the present invention and using energy dispersive X-ray analysis (EDXA), typically detected the presence of residual ionic species derived from the solvolytic decomposition or hydrolysis of the Lewis acid complexing agent. Thin films prepared with the optional neutralization and washing step of the present invention were substantially free of residual Lewis acid species. The amount of residual species remaining and detectable in thin films prepared from Lewis acid-pigment complex derived solutions of the present invention appears to depend on several process and device variables, for example, solubility of ionic species resulting from neutralization and washing of the film, concentration and molar constitution of the original Lewis acid-pigment complex used, film thickness, extent of washing, aprotic and protic solvents selected, and the like. Residual ionic products detected using EDXA ranged from a lower detection limit of about 100 counts (which corresponds to greater than or equal to about 2,000 ppm) in the case of repeated copious washings of the ultrafine pigment particles prepared to about 110–200 counts for aluminum species in the case of unwashed or rapid single washed samples. Thus, depending on the aforementioned process and device variables selected it is possible to control the residual ionic species product content to a high degree of reproducability and certainty. Representative measurements are given in the working Examples, including control data for devices prepared by known sublimation and dispersion coating methodologies.

High purity aluminum chloride and anhydrous nitromethane were from Aldrich Chemical Co., and reagent grade methylene chloride, tetrahydrofuran, and cyclohexanone solvents were from Fisher Scientific. MAKROLON® resins having molecular weight from about 50,000 to 100,000 were used. All reagents were used as received without further purification. PV Fast Blue, a copper phthalocyanine, Permanent Yellow FGL, an azo pigment, and HOSTAPERM PINK E®, a quinacridone pigment, were obtained from Hoechst. Aqueous W404 resin solution (40 weight percent) was from Witco Corp.

TRANSPORT LAYER PREPARATION

A transport layer coating solution was prepared as follow: A mixture of N,N'-diphenyl-N,N'-bis(3-methylphenyl)-[1,1'-biphenyl]-4,4'-diamine (5 gram), MAKROLON® (5 gram) and methylene chloride (56.5 gram) in an amber bottle was roll milled until complete solubilization of the solid. An under-coat layer solution of W404 was prepared by mixing an aqueous 40 weight percent W404 solution (1 gram), tetrahydrofuran (69.3 gram), cyclohexanone (29.7 gram). All layer coatings were accomplished by a Gardner mechanical driven film applicator which is enclosed in a plexiglass acrylic box with an attached cover. Bird film applicators (7.5 inches long) of different sizes were used to achieve desirable film thicknesses. MYLAR® (75 microns) substrates with Ti-Zr alloy coatings of 200–300 Angstroms were from Imperial Chemical Industries. Substrates were overcoated with a silane blocking layer(200–500 Angstroms derived from 2-aminopropyltriethoxysilane) and then an adhesive undercoat layer (200–500 Angstroms) of PE100 or 49K (both available from DuPont). The resulting substrates were named and identified as "PE 100/silane blocking layer/Ti-Zr/MYLAR®" and "49K/Ti-Zr/silane blocking layer/MYLAR®", respectively. The W404 coating solution was used to coat a thin W404 layer (200–500 Angstroms) on the silane blocking layer/Ti-Zr/MYLAR® substrates with a size 0.0005 Bird film applicator, followed by drying at 100° C. in a forced air oven for 30 minutes to give "W404/silane blocking layer/Ti-Zr/MYLAR®" substrates. All the pigment complex solutions were prepared in a glove box under nitrogen atmosphere. Pigment layer coatings were performed under ambient condition using the Gardner film applicator.

Imaging members of the present invention exhibit excellent xerographic properties in embodiments thereof. For example, values for dark development potential ($V_{ddp}$) can range from about 200 volts to about 1,000 volts of either polarity. The polarity is negative provided that the aforementioned hole transporting layers are used in conjunction with the charge generating layer is sandwiched between between the transport layer and the grounded electrode, or is positive provided that the aforementioned hole transporting layers are used in conjunction with the molecularly dispersed charge generating pigments in an inverted mode wherein the hole transporting layer is sandwiched between the charge generating layer and the substrate material, or either polarity if the charge generating pigment layer is used as a single layer photoconductor. Preferred ranges for dark development potential for the imaging members of the present invention are usually from about 200 to about 1,000 volts, with 800 volts being preferred in embodiments. High dark development potentials permit high contrast potentials, which result in images of high quality with essentially no background development.

The imaging members of the present invention in embodiments thereof also exhibit low dark decay values of, for example, about 50 volts per second or less. Low dark decay values are of importance for developing high quality images since dark decay measures the amount of charge that disappears after charging of the photoreceptor, and a large difference in charge between exposed and unexposed areas of the photoreceptor results in images with high contrast. Furthermore, low dark discharge leads to more stable voltages with changes in temperature and cycling. Acceptable values for dark decay vary depending on the design of the imaging apparatus in which the imaging members are contained. Dark decay may be as high as 100 volts per second with 50 volts and 10 to 20 volts per second being preferred in embodiments.

Residual potential values ($V_R$) for the imaging members of the present invention in embodiments thereof are excellent, ranging from, for example, about 1 volt to about 20 volts. Residual potential is a measure of the amount of charge remaining on the imaging member after erasure by exposure to flooding light and prior to imaging. Residual potentials of 5 to 15 volts are considered exceptional and preferred.

Photosensitivity values (slope of discharge S in volts per ergs per square centimeter or exposure (Exp) required to discharge from 800 to 100 volts in ergs per square centimeter) for the imaging members of the present invention in embodiments thereof are acceptable and in some instances excellent, and can be, for example, from about 20 to about 50 ergs per square centimeter. Acceptable photosensitivity values vary depending on the design of the imaging apparatus in which the imaging members are contained. Thus, in some instances, light exposure values as high as 40 or 50 volts per ergs per square centimeter are acceptable, and values of less than about 10 may be preferred.

The following Examples are being supplied to further define various species of the present invention, it being noted that these Examples are intended to illustrate and not limit the scope of the present invention. Parts and percentages are by weight unless otherwise indicated.

EXAMPLE I

Preparation of Pigment Wet Cakes

Table 1 summarizes ten exemplary pigment wet cakes prepared from precipitation of pigment/aluminum chloride nitromethane solutions. All the wet cakes were prepared according to the procedure described below for the preparation of wet cake A.

A mixture of benzimidazole perylene (BZP) (6.5 g), aluminum chloride ($AlCl_3$) (10.0 g) and nitromethane (250 mL) was magnetically stirred in a capped flask under ambient conditions for 12 to 16 hours to give a pigment-$AlCl_3$ solution. This solution was poured quickly into water (1,000 mL) while homogenizing with a Brinkmann homogenizer at 8,000 rpm). Homogenization was continued for 1 minute. The resulting pigment mixture was evenly divided into three 500 mL centrifuge bottles and centrifuged at 5,000 rpm for 15 minutes. The combined pigment wet cakes were washed with 2% $NaCO_3$ solution (1,000 mL) by homogenizing at 8,000 rpm for 1 minute. The centrifuge process was repeated followed by a second wash with methanol (1,000 mL), and then by homogenization at 8,000 rpm for 1 minute to give the wet cake A weighing 33.7 grams and having a solids content of 13.3%.

EXAMPLE II

Preparation of Pigment Dispersions

Table 2 summarizes the formulation for 12 pigment dispersions prepared from the pigment wet cakes described in Example I. Except for pigment dispersions III, IV and X, listed below, all the pigment dispersions were prepared according to the procedure described below for the preparation of pigment dispersion I. Into a 4 oz amber bottle was added pigment wet cake A (12.0 g), THF (48 mL) and polycarbonate Z or PCZ-200 resin (0.3 g) a polycarbonate available from Mitsubishi Gas Chemical Co., Japan, and ⅛" stainless steel shot (300 g). The mixture was ball milled for 1 hour to give pigment dispersion I.

EXAMPLE III

Device Fabrication

Table 3 summarizes the fabrication parameters for 16 full devices prepared from the pigment dispersions shown in Table 2. All the devices were deposited on 49K/SBL/Ti/MYLAR® substrates with the following specification. MYLAR® films (75 micrometers) with Ti coatings of 200 to 300 Angstroms were overcoated with a silane, 2-aminopropyltriethoxysilane, blocking layer (SBL) (200 to 500 Angstroms) and then an adhesive undercoat layer (200 to 500 Angstroms) of polyester 49K (available from DuPont) to 49K/SBL/Ti/MYLAR® substrates. All the devices were fabricated according to the procedure as described below for the preparation of device 1. A 49K/SBL/Ti/MYLAR® substrate (about 8"×11.5" in size) was placed on the vacuum plate of the Gardner coater and a size 0.003 Bird film applicator was placed on top of the substrate. About 1 mL of pigment dispersion 1 was applied with a pipet along the Bird film

TABLE 1

| | Pigment Wet Cake Preparation | | | | | | |
|---|---|---|---|---|---|---|---|
| | pigment-$AlCl_3$ solution | | | protic solution | | | wet cake |
| Wet cake | pigment (g) | $AlCl_3$ (g) | $CH_3NO_2$ (mL) | precipitating solution (mL) | 1st wash (mL) | 2nd wash (mL) | weight (g) (solid content %) |
| A | BZP 6.5 | 10.0 | 250 | water 1,000 | 2% $Na_2CO_3$ 1,000 | methanol 1,000 | 33.7 (13.3) |
| B | BZP 6.5 | 10.0 | 250 | 2% $Na_2CO_3$ 1,000 | water 1,000 | methanol 1,000 | 35.9 (16.5) |
| C | BZP 6.5 | 10.0 | 250 | 0.5M $NH_3$ methanol 1,000 | methanol 1,000 | — | 43.4 (11.0) |
| D | BZP 6.5 | 10.0 | 250 | water 1,000 | 1.2% $NH_4OH$ 1,000 | methanol 1,000 | 30.7 (9.2) |
| E | BZP 3.0 | 4.5 | 90 | water 500 | water 500 | methanol 500 | 8.0 (14.0) |
| F | BZP 3.0 | 4.5 | 90 | 5% HCl 500 | 5% HCl 500 | methanol 500 | 6.5 (9.8) |
| G | TiOPc* 3.5 | 5.0 | 125 | water 1,000 | 2% $Na_2CO_2$ 1,000 | methanol 1,000 | 8.1 (38.2) |
| H | BZP 12.0 | 18 | 350 | water 2,000 | water 2,000 | methanol 2,000 | 62.0 (10.0) |
| H1 ** | | | | | | | 21.7 |
| H2 *** | | | | | | | 25.2 |

*Titanyl phthalocyanine.

**A mixture of wet cake H (20.0 g) and n-BuOAc (200 mL) in a 250 mL centrifuge bottle was shaken for 10 minutes followed by centrifugation at 5,000 rpm to give wet cake H1.

***As in H1 except THF (200 mL) used in place of n-BuOAc applicator onto the substrate. A plexiglass dust cover was placed over a coating box prior to coating. After solvent evaporation (about 2 to 3 minutes) in the enclosed box, the coated substrate was hung and dried for

TABLE 2

| Pigment Dispersion | wet cake code (g) | solvent (mL) | binder polymer (g) |
|---|---|---|---|
| | Pigment Dispersion Formulation | | |
| I | A (12.0) | THF (48) | PCZ-200 (0.3) |
| II | B (10.0) | n-BuOAc (48) | B-79 (0.3) |
| III* | B (10.0) | n-BuOAc (24) | B-79 (0.3) |
| IV* | B (8.0) | n-BuOAc (24) | 8-79 (0.3) |
| V | C (14.5) | n-BuOAc (48) | B-79 (0.3) |
| VI | D (1 7.3) | THF (48) | PCZ-200 (0.3) |
| VII | E (6.4) | THF (19) | PCZ-200 (0.15) |
| VIII | F (6.4) | THF (19) | PCZ-200 (0.1 5) |
| IX | G (4.2) | THF (48) | PCZ (0.3) |
| X** | — | — | — |
| XI | H1 (21.7) | n-BuOAc (38) | 8-79 (1.0) |
| XII | H2 (25.2) | THF (34) | PCZ-200 (1.0) |

*Ball milling for 1 hour in a 2 oz amber bottle charge with 1/8" stainless steel shot (120 g).
**Prepared as follow: A mixture of 18 g each of pigment dispersions I and IX was ball milled for 10 minutes in a 1 oz bottle charged with 1/8" stainless steel shot (50 g).

minutes at ambient temperature. The dried film was then coated, using a 0.004 size Bird film applicator in the enclosed coating box, with a transport layer using a solution prepared as follows. A mixture of N,N'-diphenyl-N,N'-bis(3-methylphenyl)-[1,1'-biphenyl]-4,4'-diamine (10 gram), MAKROLON ® (10 gram) and methylene chloride (102 gram) in an amber bottle was roll milled until complete solubilization of the solid occurred. The resulting device was dried in a forced air oven at 100° C. for 30 minutes to give device 1.

TABLE 3

| Device | pigment dispersion | size of Bird film applicator for CGL coatings | CGL drying time @ RT (minutes) | appearance of CGL | thickness of CGL** (microns) | thickness of CTL (microns) |
|---|---|---|---|---|---|---|
| | | Fabrication Parameters* by Drawbar Coating and Device Description | | | | |
| 1 | I | 0.003 | 5 | dark | — | — |
| 2 | I | 0.002 | 5 | medium | — | — |
| 3 | I | 0.001 | 5 | light | — | — |
| 4 | I | 0.002 | 5 | medium | — | — |
| 5 | I | 0.002 | 5 | dark | — | — |
| 6 | I | 0.002 | 5 | dark | — | — |
| 7 | II | 0.003 | 50 | uniform light | 4 ± 1 | 25.50 |
| 8 | III | 0.002 | 30 | uniform medium | 7 ± 3 | 31.80 |
| 9 | IV | 0.002 | 30 | medium | 6 ± 2 | 30.10 |
| 10 | V | 0.002 | 60 | light | 4 ± 1 | 29.50 |
| 11 | VI | 0.002 | 5 | uniform medium purple | 1.8 ± 0.5 | 31.30 |
| 12 | VII | 0.002 | 5 | dark | 3.2 ± 0.7 | 26.70 |
| 13 | VIII | 0.002 | 5 | medium | — | 27.50 |
| 14 | IX | 0.001 | 5 | light | — | — |
| 15 | IX | 0.001 | 5 | uniform light | — | — |
| 16 | X | 0.002 | 5 | uniform light | — | — |
| | | | | uniform | | |

*In all devices, 49K/SBL/Ti/MYLAR ® substrates were used. The charge transport layers were deposited by a 0.004 size Bird film applicator.
**the thicknesses were measured by optical microscopy.

EXAMPLE IV

Electrical Evaluation

Table 4 summarizes the electrical evaluation of selected devices prepared in Example III wherein the notation $V_R$, $V_{0.2}$, S, and Exp are defined in the present specification or patents incorporated herein by references and 670 nm and 780 nm represent selected wavelengths of radiation of interest in the present invention.

TABLE 4

| Device ID | $V_R$ | $V_{0.2}$ | Dark Discharge | 670 nm S | 670 nm Exp | 780 nm S | 780 nm Exp |
|---|---|---|---|---|---|---|---|
| | | | Device Electrical Evaluation | | | | |
| 7 | 30 | 789 | 116 | 28 | 170 | 5 | >300 |
| 10 | 31 | 933 | 113 | 15 | 190 | 4 | >300 |
| 11 | 4 | 849 | 90 | 73 | 12 | 22 | 40 |
| 8 | 30 | 816 | 30 | 29 | 160 | 15 | >300 |
| 9 | 14 | 851 | 95 | 25 | 90 | 5 | >300 |
| 12 | 5 | 848 | 64 | 45 | 27 | 11 | 110 |
| 13 | 8 | 773 | 119 | 40 | 24 | 13 | 70 |

The above mentioned patents and publications are incorporated by reference herein in their entirety.

Other modifications of the present invention may occur to those skilled in the art subsequent to a review of the present application, and these modifications are intended to be included within the scope of the present invention.

What is claimed is:

1. A process for preparing ultrafine pigment dispersions comprising:

providing a solubilized mixture of a pigment-Lewis acid complex and an aprotic organic solvent;

precipitating the resulting solubilized complex into a protic solvent thereby forming a dispersion of ultrafine pigment particles;

removing the aprotic and protic solvents to afford a wet cake containing finely divided pigment particles;

optionally neutralizing and washing the wet cake particles; and redispersing the resulting ultrafine pigment particles in an aqueous solution, an organic solvent, or mixtures thereof, and a binder resin to form an ultrafine pigment and binder resin dispersion.

2. A process according to claim 1 further comprising coating the redispersed pigment and binder mixture onto a substrate to form a photogenerating film or coating layer thereon; drying the film layer or coating layer; and optionally applying a charge transporting layer and optionally a protective overcoating layer to the coated substrate.

3. A process according to claim 1 wherein the pigment is selected from the group consisting of metal phthalocyanines, metal-free phthalocyanines, oligomeric phthalocyanines, quinacridones, benzimidazole perylenes, perylene tetracarboxyl diimides, substituted 2,4-diamino-triazines, squaraines, polynuclear aromatic quinones, thiopyrylium compounds, and mixtures thereof.

4. A process according to claim 1 wherein the pigment concentration in the solubilized pigment-Lewis acid complex solution is from about 0.005 to about 50 weight percent.

5. A process according to claim 1 wherein the Lewis acid is a metal halide selected from the group consisting of $AlCl_3$, $GaCl_3$, $FeCl_3$, $InCl_3$, $SnCl_4$, $BF_3$, $ZnCl_2$, $TiCl_4$, $SbCl_3$, $SbCl_5$, $CuCl_2$, $SbF_5$, $VCl_4$, $TaCl_5$, $ZrCl_4$, $AsF_3$, and mixtures thereof.

6. A process according to claim 1 wherein the binder resin is selected from the group consisting of polycarbonates, acrylate polymers, vinyl polymers, polyvinylcarbazole, polyvinylbutyrals, polystyrene and copolymers thereof, polyesters, polysiloxanes, polyamides, polyurethanes, epoxies, and mixtures thereof.

7. A process according to claim 1 wherein the aprotic solvent is selected from the group consisting of methylene chloride, chloroform, trichloroethane, 1,2-dichloroethane, nitroalkanes or nitroalkenes having from 1 to 6 carbon atoms, benzene, toluene, and mixtures thereof.

8. A process according to claim 1 wherein the protic solvent is selected from the group consisting of water, methanol, ethanol, propanol, iso-propanol, acetic acid, and mixtures thereof.

9. A process according to claim 2 wherein the substrate is selected from the group consisting of an organic polymer, a conductive metal drum, a cylindrical sleeve, and an endless belt.

10. A process according to claim 2 wherein coating the ultrafine pigment and resin dispersion onto a substrate to form a thin film is achieved by casting, spraying, dipping, spin casting or spinning.

11. A process according to claim 2 further comprising drying the coated substrate by heating at a temperature of from about 5° to about 60° C. for 1 to about 300 minutes.

12. A process according to claim 11 further comprising the step of removing the coating from the substrate to yield a free-standing film.

13. A process according to claim 1 wherein pigment-Lewis acid complex is comprised of a molar ratio of Lewis acid to pigment of from about 1:1 to about 20:1.

14. A process according to claim 1 wherein pigment-Lewis acid complex is comprised of a molar ratio of Lewis acid to pigment of from about 5:1 to about 10:1.

15. A process in accordance with claim 2 wherein the resulting photoconductive imaging member has a layer configuration wherein: the photogenerating layer is in contact with and is situated between the supporting substrate and the charge transporting layer; or the charge transporting layer is in contact with and is situated between the supporting substrate and the photogenerating layer.

16. A process in accordance with claim 15 wherein the photoconductive imaging member includes a metal oxide hole blocking layer in contact with and situated between the supporting substrate and the photogenerating layer.

17. A process in accordance with claim 16 wherein the metal oxide hole blocking layer is aluminum oxide with a thickness of from between about 100 and about 500 Angstroms.

18. A process in accordance with claim 16 wherein the photoconductive imaging member contains an adhesive interface layer selected from the group consisting of polyester, polyvinylbutyral, and polyvinyl pyrrolidone in contact with and situated between the supporting substrate and the metal oxide hole blocking layer with a thickness of from between about 0.1 and 0.6 micron.

19. A process in accordance with claim 15 wherein the photogenerating layer has a thickness of from about 0.05 to about 10 micrometers and the charge transport layer has a thickness of from about 5 to about 50 micrometers.

20. A process in accordance with claim 15 wherein the charge transport layer is a hole transport layer comprised of an aryl amine compound:

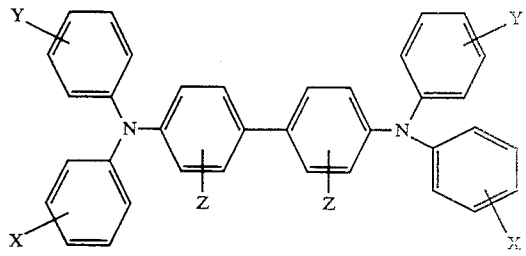

dispersed in a highly insulating and transparent organic resinous binder and wherein X, Y and Z are selected from the group consisting of hydrogen, an alkyl group with from 1 to about 25 carbon atoms and a halogen, and at least one of X, Y and Z is independently an alkyl, hydroxy, or a halogen group.

21. A process in accordance with claim 20 wherein X is selected from the group consisting of ortho ($CH_3$), meta ($CH_3$), para ($CH_3$), meta (—$OCH_3$), para (—$OCH_3$), ortho (OH), meta (OH), para (OH), ortho (Cl), meta (Cl), and para (Cl).

22. A process in accordance with claim 20 wherein the resinous binder is a polyester, a polyvinyl butyral, a polystyrene and copolymer thereof, a polycarbonate, a polyvinyl carbazole, or a polyvinyl formal.

23. A process in accordance with claim 2 wherein the substrate is a metal or metalized polymer selected from the group consisting of aluminum, titanium, nickel, aluminized polyester, and mixtures thereof, having a thickness of from about 3 to about 100 mils.

24. A process in accordance with claim 1 further comprising optionally drying the wet cake of finely divided pigment particles prior to redispersing with a binder resin.

25. A process in accordance with claim 1 wherein the finely divided pigment particles in the wet cake or in the redispersed mixture with a binder resin have a primary particle size average of less than about 20 to about 80 Angstroms.

26. A process in accordance with claim 1 wherein the aqueous or organic solvents used for redispersing the wet cake ultrafine pigment particles in a binder resin is selected from the group consisting of water, methanol, ethanol, propanol, iso-propanol, acetic acid, n-butyl acetate, formamide, acetone, acetonitrile, dimethylformamide, n-methyl-2-pyrrolidone, and mixtures thereof.

27. A process in accordance with claim 1 wherein the pigment is selected from the group consisting of hydroxy gallium phthalocyanine, HOSTAPERM PINK E®, metal phthalocyanines, metal-free phthalocyanines, quinacridones, benzimidazole perylenes, perylene tetracarboxyl diimides, substituted 2,4-diamino-triazines, squaraines, polynuclear aromatic quinones, thiopyrylium compounds, derivatives thereof, and mixtures thereof.

28. A process in accordance with claim 1 wherein the redispersed pigment particles may be used to form films without filtering prior to coating.

29. A process in accordance with claim 1 wherein the wet cake has a solids content of from about 5 weight percent to about 30 weight percent of the total weight of the wet cake.

30. A process in accordance with claim 1 wherein the wet cake has a shelf life at ambient temperature of in excess of about 2 to 5 years.

31. A process in accordance with claim 1 wherein the resulting ultrafine pigment dispersion has an average primary particle size of less than from about 30 to 50 Angstroms.

32. A process in accordance with claim 1 wherein the resulting ultrafine pigment dispersion has an average primary particle size that is about 2 to about 3 times smaller than that obtainable by pigment sublimation or attrition processes.

33. A process in accordance with claim 1 wherein the ultrafine pigment particle dispersion is neutralized with aqueous base selected from the group consisting of ammonium hydroxide, alkali metal salts of carbonates, acetates, benzoates, and mixtures thereof.

34. A process in accordance with claim 1 wherein the protic solvent contains an additive selected from the group consisting of a surfactant, a pigment dispersant, a colloidal stabilizer, and mixtures thereof.

35. A process in accordance with claim 1 wherein the redispersed pigment further comprises an additive selected from the group consisting of a surfactant, a pigment dispersant, a colloidal stabilizer, and mixtures thereof.

36. A process in accordance to claim 1 wherein the protic solvent further comprises a mixture of solvents containing at least one protic solvent and a second solvent selected from the group consisting of formamide, acetone, acetonitrile, dimethylformamide, N-methyl-2-pyrrolidone, and mixtures thereof.

37. A photoconductive imaging member prepared by the process of claim 2 wherein said imaging member is used in, or in conjunction with, an optoelectronic device selected from the group consisting of light emitting diodes, organic electroluminescent emitters, field effect transistors, vacuum fluorescent displays, thin film transistors, and liquid crystal displays.

38. A photoconductive imaging member of claim 37 further comprising two or more adjacent photogenerating layers wherein each layer is comprised of a dissimilar ultrafine pigment dispersion and a binder which binder is the same of dissimilar in each layer.

39. A photoconductive imaging member of claim 38 wherein the ultrafine pigment dispersion is a mixture of at least two pigments comprising a first pigment of from about 1 to about 50 weight percent of the pigment mixture and a second pigment of from about 10 to about 90 weight percent of the pigment mixture.

40. A method of imaging comprising the steps of:

(a) generating an electrostatic image on the photoconductive imaging member of claim 2;

(b) subsequently developing the electrostatic image;

(c) transferring the developed electrostatic image to a suitable substrate; and (d) permanently affixing the transferred image to the substrate.

* * * * *